US005556228A

United States Patent [19]

Smith

[11] Patent Number: 5,556,228

[45] Date of Patent: Sep. 17, 1996

[54] BLOCK FOR CONTROLLING SOIL EROSION

[76] Inventor: Lee A. Smith, 6917 Sunday Pl., Fort Worth, Tex. 76133

[21] Appl. No.: 383,825

[22] Filed: Feb. 6, 1995

[51] Int. Cl.[6] ..... E02B 3/12

[52] U.S. Cl. ..... 405/16; 52/604; 405/20

[58] Field of Search ..... 405/16, 17, 19, 405/20, 28, 30; 404/40, 41, 42; 52/591.1, 591.3, 592.2, 592.4, 604

[56] References Cited

U.S. PATENT DOCUMENTS

| | | | |
|---|---|---|---|
| 3,168 | 7/1843 | Terry | 404/41 |
| Re. 32,663 | 5/1988 | Atkinson | 405/19 |
| 708,470 | 9/1902 | Flood | 404/42 |
| 930,153 | 8/1909 | Butz | 404/40 |
| 1,164,707 | 12/1915 | Edinger | 405/20 |
| 1,436,896 | 11/1922 | Newell | 404/40 |
| 3,093,568 | 6/1963 | Cox | 204/193.2 |
| 3,096,695 | 7/1963 | Reinhardt | 404/43 |
| 3,310,906 | 3/1967 | Glukes | 46/25 |
| 3,420,275 | 1/1969 | Glen et al. | 138/96 |
| 4,227,829 | 10/1980 | Landry, Jr. | 405/20 |
| 4,370,075 | 1/1983 | Scales | 405/20 |
| 4,372,705 | 2/1983 | Atkinson | 405/19 |
| 4,474,504 | 10/1984 | Whitman et al. | 405/16 |
| 4,875,803 | 10/1989 | Scales | 405/16 |
| 5,360,285 | 11/1994 | Barth et al. | 404/42 X |
| 5,409,325 | 4/1995 | Wu | 52/604 X |
| 5,429,451 | 7/1995 | Pettee, Jr. | 405/16 X |
| 5,484,230 | 1/1996 | Rudloff | 405/20 |

FOREIGN PATENT DOCUMENTS

| | | | |
|---|---|---|---|
| 497010 | 11/1950 | Belgium . | |
| 566937 | 11/1923 | France . | |
| 7438621 | 6/1975 | France . | |
| 7532233 | 5/1977 | France . | |
| 1534368 | 5/1969 | Germany . | |
| 2141107 | 3/1973 | Germany | 405/16 |
| 2332536 | 1/1975 | Germany | 52/592 |
| 546700 | 4/1956 | Netherlands . | |
| 247616 | 2/1926 | United Kingdom . | |
| 267832 | 3/1927 | United Kingdom . | |
| 2025494 | 1/1980 | United Kingdom . | |

OTHER PUBLICATIONS

Protec color advertising brochure (undated).

Rudloff brick brochure, one page (undated).

*Primary Examiner*—William P. Neuder

*Attorney, Agent, or Firm*—Richards, Medlock & Andrews

[57] ABSTRACT

An erosion control block of octagonal shape, having a pair of arms extending from a peripheral side edge thereof, and a pair of cavities formed in the block with openings to the peripheral side edge. The block interlocks with other similar blocks and provides an effective interlocked matrix of such blocks. The arms have enlarged ends that loosely fit within the cavities, thereby allowing rotation about a vertical axis of one block with regard to another block. When two blocks are interlocked and rotated to the fullest extent, peripheral edges of the blocks abut, thereby placing a radial tension strain on the neck of the arm, rather than a lateral strain, thereby reducing the possibility of breakage of the arms.

21 Claims, 5 Drawing Sheets

BLOCK FOR CONTROLLING SOIL EROSION

TECHNICAL FIELD OF THE INVENTION

The present invention relates in general to techniques for controlling erosion of soil and the like, and more particularly to a type of block that can be interlocked with other similar blocks, and provide a certain degree of pivotal freedom so that a number of such blocks can be laid in a curved path and maintained in an interlocking arrangement to resist movement due to the flow of water.

BACKGROUND OF THE INVENTION

The erosion of soil due to the flow or movement of water, such as experienced on beaches, lake shores, waterways, channels and water shed areas is a significant concern both as to the deterioration of the land, as well as the soil contamination of the water. The expense and cost to repair such type of erosion can be substantial, often raging in the millions of dollars. Further, the repair of such type of eroded properties includes not only the rebuilding of the land, but often the subsequent removal of the soil which has been washed or carried down stream and settled in the navigation waterways. Also, eroded soil carried by run off water often finds its way into city and municipal drainage systems, thereby causing other concerns and expenses of removal.

Revetment or erosion control blocks have been developed to limit or control the erosion of soil due to the movement of water. A number of different styles of revetment blocks are currently available for satisfying particular needs. For example, U.S. Pat. No. 4,875,803 by Scales discloses blocks having interfitting tongues and cavities to prevent relative movement of one block with respect to the other. Because of the construction of the tongues and cavities, such blocks cannot be utilized in a curved path, although such blocks do provide a degree of flexibility to conform to vertical contours and curvatures of the ground. When the area to be protected with such type of blocks is curved, pie-shaped sections of grout between sections of blocks must be installed to accommodate corners and the like. A serious disadvantage of the Scales revetment block system is that, depending upon the arrangement, blocks with two tongues and four cavities are utilized, blocks with three tongues and three cavities are utilized, and blocks with four tongues and two cavities are utilized, as noted in FIG. 9 of the patent. Because of the different styles of blocks utilized, each block must be selected and studied briefly in order to determine how it should be oriented before being installed with the other blocks. Because of the difficulty in installing each block, the entire installation of a number of such blocks necessarily takes longer. Another severe disadvantage of the Scales blocks is the replacement of one or more blocks after the matrix of blocks has already been installed. Because of the nature of the interfitting tongue and cavities, the blocks cannot be lifted out of the matrix and replaced with another block. Rather, the replacement requires entire rows or sections to be removed in order to replace a single block. More practically, if a block is broken, the relevant area is simply grouted or cemented, which compromises the vertical flexibility of the matrix. Additionally, because of the nature of the tongues and cavities in the various blocks, they cannot be block cast, but only can be made by wet casting techniques.

U.S. Pat. Nos. 4,227,829 and 4,370,075 respectively by Landry, Jr. and Scales describe other revetment blocks that are cabled together so as to maintain a system of such blocks in a group to control the erosion of soil.

U.S. Pat. No. 4,372,705 reissued as Re. U.S. Pat. No. 32,663 describes an articulated erosion control system utilizing two entirely different types of blocks that are interlocked together. A "lock block" is constructed entirely of a number of sockets, and a "key block" is constructed only with a number of locking arms. The lock blocks and key blocks are interlocked together and can be cabled to facilitate installation. Although the lock and key blocks are structured so that a number of them can be installed in a curved path, the arrangement has certain disadvantages. For example, since two entirely different types of blocks are necessary, the different types of blocks must be available and alternately selected by the installer during installation thereof. Also, if one type of block is broken, during or before installation, then it must be replaced with an identical type. It can be appreciated that the installation, inventory and manufacture is thus more complicated, due to the necessity of two different types of blocks. Further, the arms of the key block are susceptible to breakage when installed in the socket of a lock block, and rotated or angled sideways. Because such type of blocks are constructed of concrete, the material is susceptible to breakage at the thinned portion of the arm, when such portion engages the edge in the opening of the socket and when rotated sideways to the fullest extent. The installation of a system of such blocks is also more complicated, in that the blocks are installed in a diagonal manner, rather than along the x-y laterals of a matrix. Lastly, the cabling of such blocks is more of a necessity to prevent dislodgement due to flowing water because the key blocks are lighter in weight than the lock blocks, and thus have a tendency to be more easily lifted out of place and carried with flowing water. Because of the structure and arrangement of the key and lock blocks, the cabling thereof is substantially more difficult. The entire disclosures of the foregoing patents are incorporated herein by reference.

French Pat. No. 75 32233 discloses a terrain erosion control block that is interlocking and requires only a single type of block. However, because of the length of the arms that extend substantially away from the block itself, a high likelihood exists that one or more of the arms will be broken during transportation, handling or installation. Also, rotation of blocks with respect to each other a maximum amount can exert a cross-sectional or transverse strain on the arms, thereby increasing the probability of breaking the thin and elongated arms.

From the foregoing, it can be seen that a need exists for an interlocking erosion control block that substantially reduces or eliminates many of the foregoing disadvantages. In particular, a need exists for a structurally strong interlocking block that is flexible with respect to other such blocks. A further need exists for a block of only which one type is required, is more easily manufactured, as well as installed. A further need exists for an interlocking type of block where the breakage of the exposed arms is less likely, especially when arranged to follow a curved path. A further need exists for a simplified erosion control block that can be constructed by either the wet cast or block cast techniques.

SUMMARY OF THE INVENTION

In accordance with the principles and concepts of the invention, each block includes a pair of arms and a pair of receptacles for interlocking with other similar-type blocks.

Each arm has an enlarged, end portion that is loosely fittable within a corresponding receptacle so that one block can be rotated sideways somewhat with respect to adjacent blocks, thereby allowing such blocks to be laid or installed in a curved path.

In accordance with an important aspect of the invention, each receptacle and each arm is formed on the peripheral edge of the block. Each receptacle formed within the body of each block is larger than an entrance opening formed in the edge of the block. The length of the arm, between the enlargement and the edge of the block, is longer than the entrance opening of the receptacle, thus allowing one block to be rotated sideways with respect to the other block. Also, when rotated sideways to the full extent, a cross-sectional stress is not applied to the thinned part of the arm by the receptacle opening, thereby reducing the chances of brakeage. Rather, a portion of the edge face of one block abuts the edge face of an interlocked block when rotated sideways, thus providing a radial strain on the arm.

According to one embodiment of the erosion control block of the invention, the arms are formed on diametric opposing edges of the block, while the receptacles are formed on different corresponding diametric opposing edges. In another embodiment, the arms are formed spaced apart from each other 90°, while the receptacles are also spaced apart from each other 90°.

According to another feature of the invention, only a single type of block is necessary to provide an interlocking arrangement, and each block can be easily installed along x-y coordinates of a matrix. Further, the blocks can be cabled together for underwater installation, and can be provided with different thicknesses to achieve desired weights for use with different velocities or flow rates of water. An additional advantage of the invention is that the block can be reversed as to the top and bottom, and thus the blocks can be easily installed with minimal orientation by the personnel. Also, the blocks can be either wet cast or block cast to achieve the various advantages thereof.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
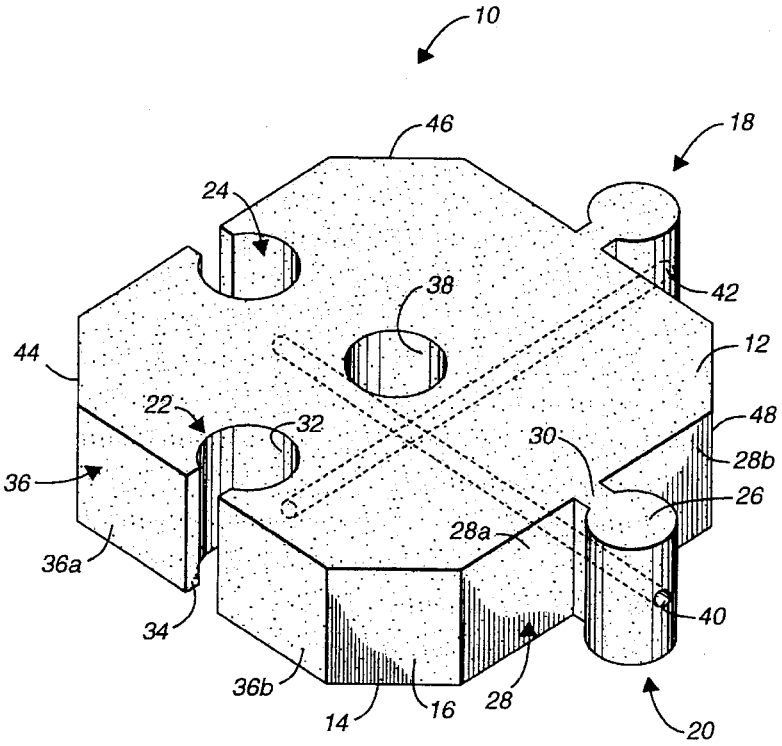
FIG. 1 is an isometric view of the preferred embodiment of the erosion control block of the invention.
Figure 4:
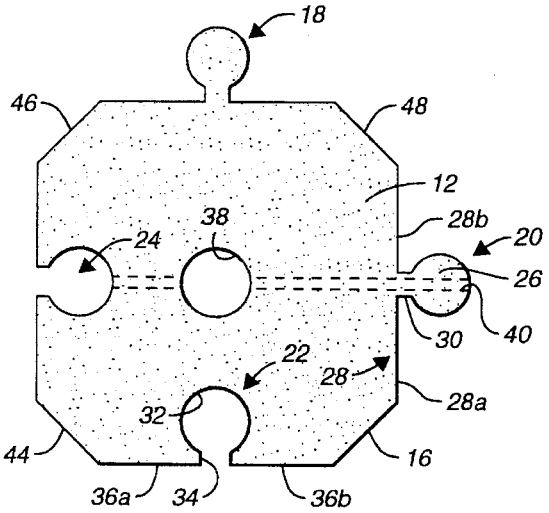
FIGS. 4 and 5 are respective top and side views of the erosion control block of FIG. 1.
Figure 5:
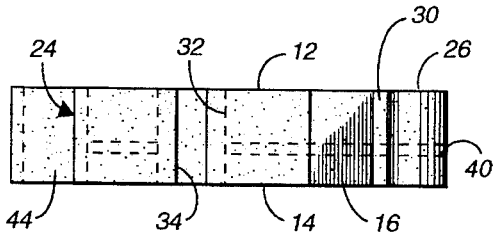
Figure 2:
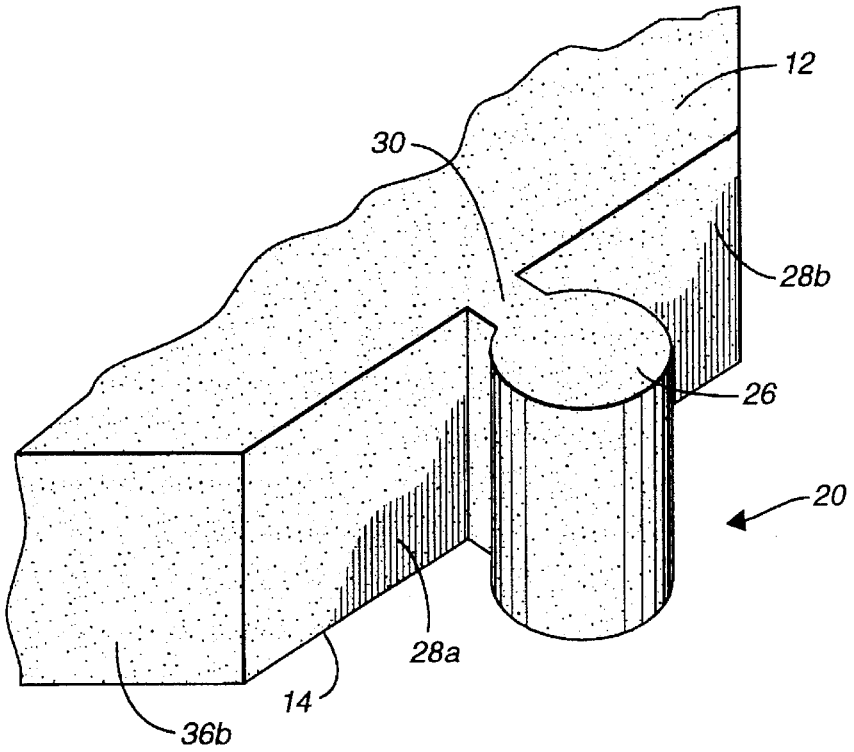
FIG. 2 is a partial isometric view of the arm, defined by the necked down portion and the enlarged portion of the erosion control block.
Figure 3:
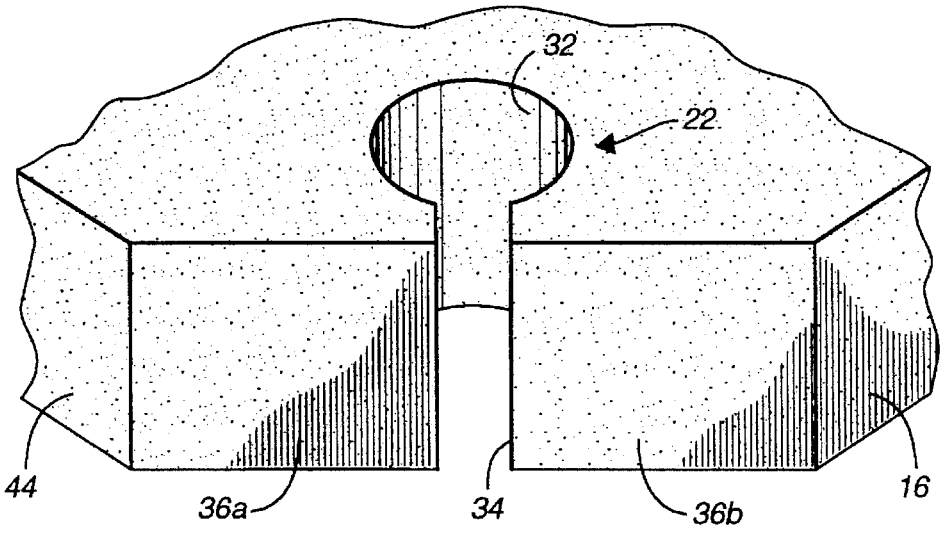
FIG. 3 is a partial isometric view of the receptacle, defined by an entrance opening and a cavity of the erosion control block.

With reference now to FIGS. 1–5 of the drawings, there is illustrated an erosion control block that overcomes many of the disadvantages and shortcomings of the prior art identified above. The block 10 is of a relatively noncomplicated design, including a generally flat top face 12 and a flat bottom face 14, either of which can be laid on the ground. The block 10 is generally octagonal in shape which has distinct hydraulic advantages, but which is not required to realize the basic features and advantages of the invention. When the erosion control block 10 of the invention is constructed as shown in FIG. 1, eight edge faces, one as shown as reference numeral 16, are formed, which faces are generally perpendicular to the top and bottom faces 12 and 14. However, various configurations of bevels or corner shapes can be utilized to still achieve the basic advantages of the invention.

Each block 10 includes a pair of arms 18 and 20 and a pair of receptacles 22 and 24. The arms 18 and 20 are substantially identical in shape, as are the receptacles 22 and 24. Each arm 18 and 20 includes an enlarged portion 26 connected to a respective edge face 28 by way of an extension 30 that is a narrowed or necked down portion. The arm 20 is substantially in the center of the edge face 28, with a portion of the face **28*a* and 28*b* that extends on each side of the arm extension 30**.

Each block receptacle, such as 22, includes a cavity 32 defining a void that extends through the block 10 from the top face 12 to the bottom face 14. The cavity 32 includes an entrance portion 34 defined by a narrow opening that connects the edge face 36 to the cavity 32. The cavity 32 and the entrance opening 34 are of uniform shape from the top face 12 of the block 10 to the bottom face 14 thereof. The same uniformity from the top face to the bottom face exists as to each of the arms 18 and 20. With such construction, the block 10 can be formed either by block cast techniques, or by wet cast techniques.

Optionally, the block 10 can include an opening 38 formed therethrough for allowing vegetation to grow through the block, thereby enhancing anchoring of the block to the ground. Again, the opening 38 can be of any desired size, and formed at different locations on the block 10 from that shown in FIG. 1. Further, a number of openings can be formed in the block 10 to allow a block of a given size to be lighter in weight, or to further facilitate anchoring of the block by vegetation. As a further option to the forming of the block 10, one or more cable channels 40 and/or 42, can be formed as shown to maintain a matrix of such blocks locked together when the matrix is hoisted off the ground for installing under water.

The erosion control block 10 can be made with various dimensions and sizes to achieve various individual advantages. Further, the erosion control block 10 can be fabricated as a nonregular hexagon, meaning that the corner edge faces, 16 and 44–48 can be of a shorter lateral dimension than the edge faces on which the respective arms and receptacles are formed. Indeed, the corner edge faces 16 and 44–48 can be eliminated, thus defining a square or rectangular shaped block. As will be noted below, the provision of corner edge faces 16 and 44–48 provide openings between blocks of a matrix of such blocks, again for the growth of vegetation to facilitate anchoring of the blocks to the ground.

According to a preferred form of the invention, the erosion control block 10 is formed with a 4000 psi type of conventional mix of concrete and aggregate, although other strengths or materials can be utilized. Blocks chosen with various dimensions and thicknesses provide corresponding weights, and thus can be utilized with applications exposed to different water flow velocities. The hydraulic stability of a block is thus related to its weight, in conjunction with a range of water velocities. For example, standard practices dictate that an erosion control block weighing about 32–35 pounds per square foot (PSF) is usable in applications where the water velocities are between about 10–14 feet per second. A major portion of the applications fall in this range. Blocks weighing between about 40–44 PSF are generally well adapted for use where water flow velocities are in the range of about 14–18 feet per second. Lastly, blocks weighing about 60–65 PSF are well adapted for applications where the water flows at a rate of about 18–23 feet per second.

According to a preferred form of the invention, the enlarged portions 26 of each arm are about 3.5 inches in diameter, whereas the cavity 32 is about 4.0 inches in diameter. Accordingly, the enlarged portion 26 of the arm 20 is loosely fittable into the cavity 32 of an adjacent similar block, thereby allowing a certain degree of freedom for rotation about a vertical axis of one block with regard to another block. Moreover, the arm extension 30 has a length of about 0.75 inches, which is the dimension by which the enlarged portion 26 of the arm 20 is displaced radially from the edge face 28 of the block 10. The distance by which the cavity 32 is spaced from the edge face 36 is about 0.50 inches, which is shorter than the length of the arm extension 30. With this arrangement, adjacent blocks need not be engaged together with full contact between the mating edge faces, but, again, can be spaced in many degrees of freedom and laterally rotated sideways with respect to each other, but remain interlocked. The distance by which the cavity 32 is spaced from the edge face 36 defines the radial length of the entrance opening 34. The lateral width of the entrance opening is about 2.75 inches, while the lateral width of the arm extension 30 is about 2.25 inches, again defining a loose or slocky fit between the mating parts.

In order to obtain desired block weights using standard and well-known thickness dimensions, the preferred dimensions of the erosion control block 10 are as follows. The diametric dimension between the block edge faces on which either the arms or cavities are located, is about 14.5 inches. The lateral width of the edge faces associated with either the arms or cavities is about 8.5 inches, while the corner edge faces 16 and 44–48 are about 4.5 inches wide. With such a block having a thickness of about 4.0 inches, the block weight is about 32–35 PSF, or a total of about 53 pounds. Such a block with a thickness of about 6 inches has a weight of about 40–45 PFS, with a total weight of about 80 pounds, while an 8-inch thick block weighs about 66–71 PSF, or a total weight of about 107 pounds. Of course, blocks with other dimensions and weights can be utilized.

In accordance with an important feature of the invention, blocks of different thicknesses can be utilized in the same installation site to accommodate areas of different water flow velocities. In other words, interlocking blocks of different thicknesses can be mixed and matched together. Further, if it is found that an installation of blocks of the same thickness requires modification, then the old blocks in a certain area can be easily removed upwardly, and heavier blocks can be installed in the existing matrix. This allows different weight blocks to be utilized in an area experiencing a heavier water flow velocity, as compared to other areas of the installation site where lower water velocities occur. Also, broken blocks can be easily replaced by lifting them out of the existing matrix and lowering new blocks into an interlocking relationship with the surrounding blocks. This avoids removing an entire row or section of blocks to replace a single block, and avoids the necessity of grouting over broken blocks or grouting over an area to achieve or accommodate higher than expected water flow velocities.

Figure 6:
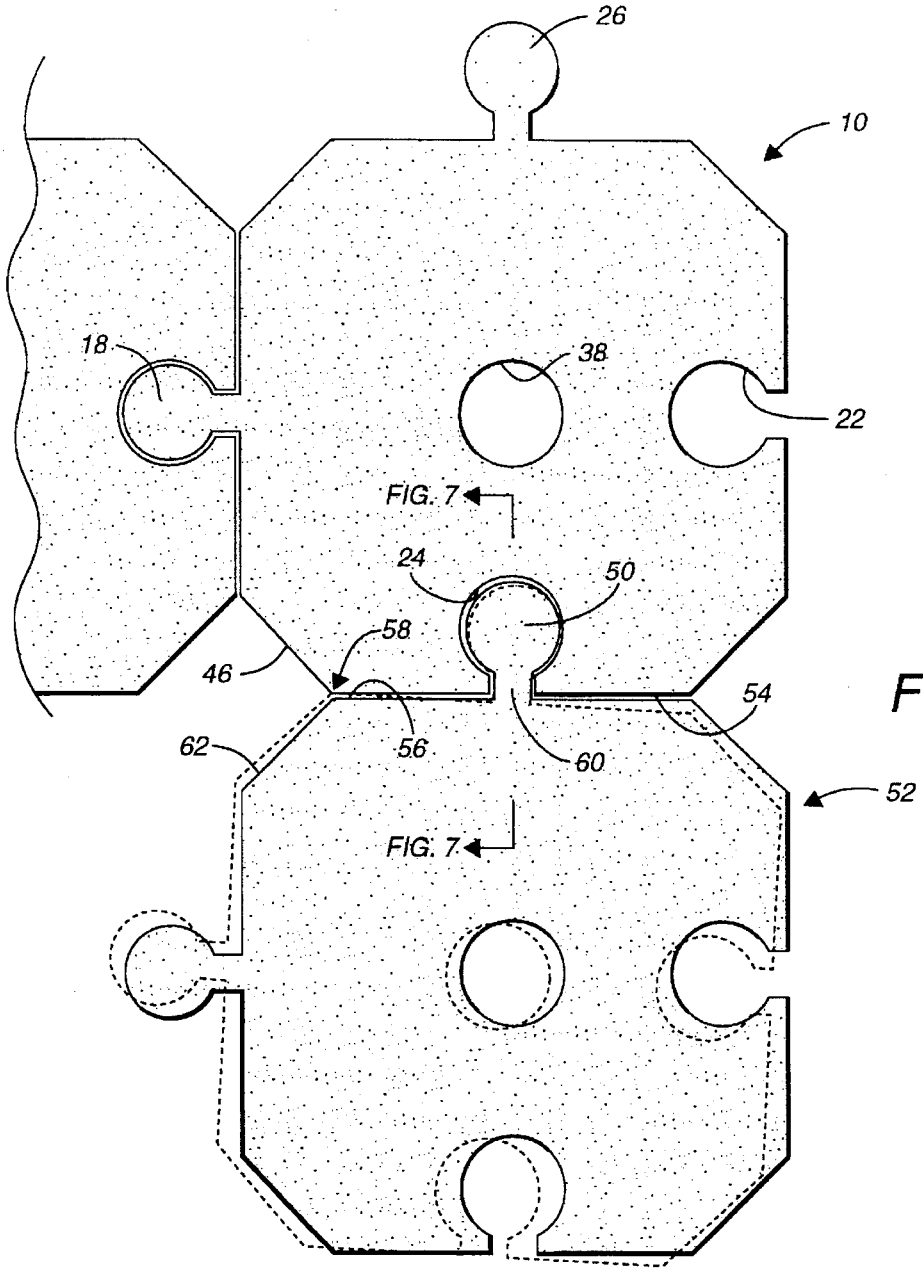
FIG. 6 is a top view of an interlocked arrangement of the erosion control blocks of the invention, illustrating the rotatability of one block with respect to another so that a curved path of the same can be achieved.

With reference to FIG. 6, there is illustrated the loose fitting arrangement between the cavity 24 of block 10 and the interlocking arm 50 of block 52. The relative dimensions of the cavity 24 and the arm 50 noted above allow the blocks 10 and 52 to abut each other, so that the face 54 of block 10 fully abuts and is in contact with the face 56 of block 52. When fully separated from each other and not rotated, but remaining interlocked together, the faces 54 and 56 are spaced from each other about 0.75 inches. However, when it is desired to install the blocks along a curved path, the looseness between the arm 50 and the cavity 24 allows one block to be rotated with respect to another, such as shown in FIG. 6 in broken line where block 52 is rotated somewhat clockwise with regard to block 10. When rotated about a vertical axis, the enlarged portion of the arm 50 engages that portion of the cavity 24 which is adjacent the entrance portion, and the face 54 of block 10 engages the face 56 of block 52 at the small area identified by reference numeral 58.

The rotation in the manner noted constitutes a clockwise rotation to a maximum extent, wherein the arm extension 60 of block 52 does not experience a cross-sectional tension stress thereacross, but rather experiences a radial tension stress. The cement material of the block can withstand a greater radial tension stress than a cross-sectional stress, thereby reducing the probability of breaking the arms during the installation and rotation of the blocks to accommodate curved paths of a matrix of such blocks. In accordance with the invention, when the majority of the stress induced in the arm extension 30 is in a radial rather than a transverse direction, the probability of reducing breakage of the arm is substantially reduced. A block constructed with the dimensions identified above can be rotated with regard to another block a maximum extent of about 15°. Also, as can be noted in FIG. 6, the corner face 46 of block 10, together with corner face 62 of block 52 defines two sides of an opening through which vegetation, and the like, can grow to facilitate anchoring of the block. As can be appreciated, the greater the lateral dimension of corner faces 46 and 62, the larger the corner opening between blocks. Conversely, the smaller the corner opening between blocks, the greater the hydraulic stability, due to the inability of water to flow under the blocks and lift the blocks. Additionally, by making the lateral dimension of the corner edge face 46 larger, the engaging point 58 of rotated blocks is closer to the respective cavity 24 and arm enlargement 50, and thus the greater the angle of rotatability.

Figure 7:
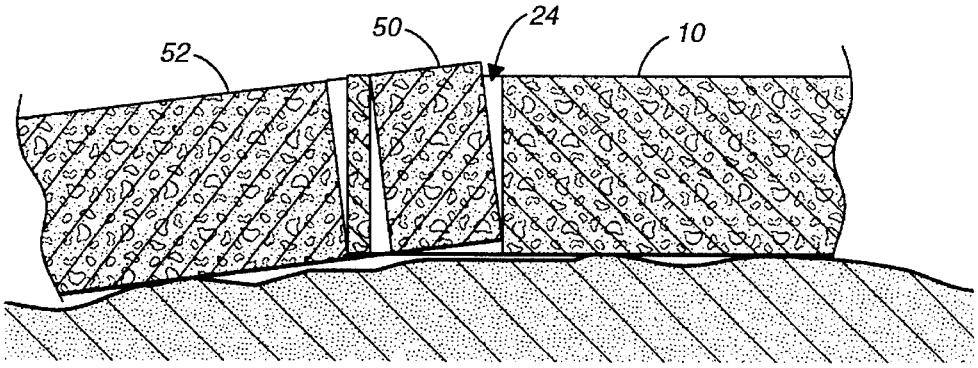
FIG. 7 is a side view of a pair of interlocked erosion control blocks, illustrating the ability to conform to contoured surfaces of the soil bed.

With reference to FIG. 7, there is illustrated the manner in which the interlocking blocks 10 and 52 can be vertically rotated so as to conform to the curvature of the ground. Again, the rotatability about a horizontal axis of one block with regard to an interlocked block is achieved because of the loose fitting nature between the arm enlargement 50 of block 52 and the cavity 24 of block 10. It can be appreciated that blocks formed according to the invention can be installed so as to be rotated about both a vertical and a horizontal axis, such as experienced when the ground is contoured and the path to be protected from erosion is curved.

Figure 8:
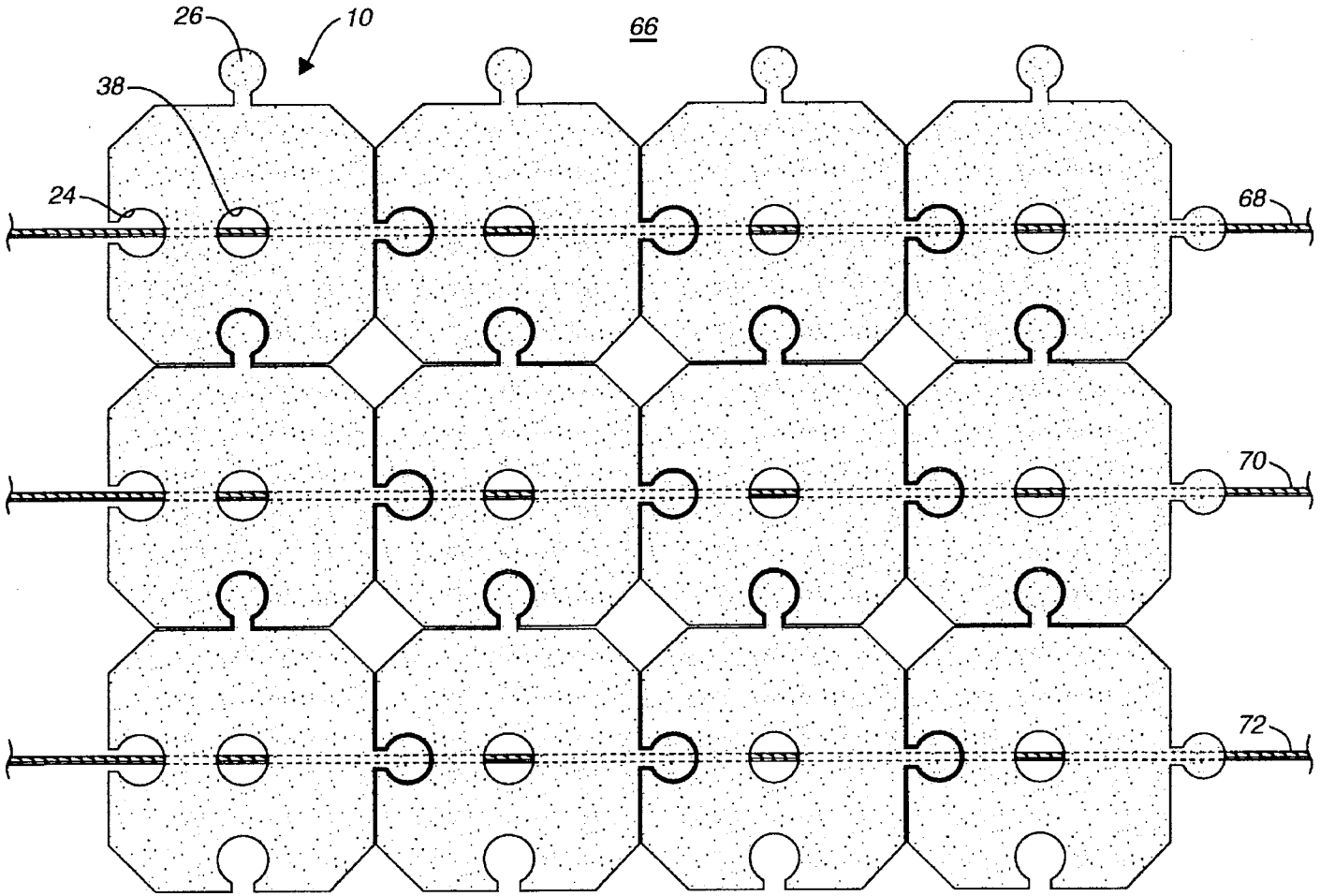
FIG. 8 is a top view of a number of interlocked erosion control blocks of FIG. 1 cabled together for underwater instillation.

The erosion control blocks of the type shown in FIG. 1 are shown as an interlocked matrix in FIG. 8. Here, although the interlocked matrix 66 is shown with cables 68–72 threaded through the erosion control blocks, such cabling is generally necessary only in underwater installations of the erosion control blocks. Otherwise, the interlocking arm and socket arrangement between each adjacent block maintains the various blocks attached to each other, although moveable with respect to each other in a lateral and vertical direction for conformance to respective curved paths. Although FIG. 8 illustrates only 12 interlocked erosion control blocks of the invention, many more such blocks would be used in an actual installation. It is noted that each interior block that is not on the periphery of the matrix 66 is interlocked at each of the four sides thereof to other similar blocks. Of course, the perimeter blocks are interlocked at three corresponding sides, while the corner blocks are interlocked to other blocks at only two sides thereof.

Based on the efficient design of each erosion control block 10, an installer can start the matrix in the middle of an area and add interlocking blocks in any of the directions therefrom, or can start at any of the top, bottom, left or right sides of an installation site and complete the matrix by adding interlocking blocks thereto. In other words, the installation is not complicated and can be easily learned and quickly accomplished without a high degree of skill. With regard to the perimeter blocks of a matrix, if it is desired to have a smooth edge, the arms 26 that extend outwardly from the matrix and are not interlocked with other blocks, can simply be knocked off with a sledge hammer or the like. A substantially smooth perimeter surface is thus achieved so that the matrix can be abutted against edging material, or simply to achieve a pleasant aesthetic appearance for the matrix 66.

As noted above, cabling can be utilized as a carrier to lift a matrix 66 of interlocking blocks and lower the matrix to an underwater location. A matrix that is cabled in the manner shown in FIG. 8, and measuring about 8 feet by 40 feet, can be lowered into the water-covered area to be protected against erosion. The cables can be connected to a beam, such as shown in U.S. Pat. No. re. 32,663 so that the entire matrix can be lifted by a crane and lowered into the water. The cables 68–72 can be of suitable diameter, stranded material such as ¼, 5/16 or ½ inch polyester revetment cable which is a high strength material, and which resists rust and deterioration when exposed continuously to fresh water or salt water.

It is important to note in FIG. 8 that a single cable can be utilized and passed through the cable channel of each row of blocks of the matrix 66, and all the rows of the matrix remain interlocked together. In other words, because only a single cable passes through each block, the block does not have a tendency to rotate about the cable extended therethrough and become disengaged from the blocks in the adjacent rows. Although each block, when interlocked with another block as shown in FIG. 7, has a certain degree of rotatability about a horizontal axis to conform to the curvature of the ground, the arm of one block cannot become completely disengaged from the cavity of another block because of the lateral dimension of the block as a whole, as well as the thickness thereof. The enlarged portion 50 of the arm cannot thus be rotated out of the cavity 24 of an adjacent block, unless the one block is lifted vertically from engagement with the other block. Thus, an efficiency in the underwater instillation of a matrix of blocks of the invention is achieved.

During underwater installation of a matrix of blocks such as shown in FIG. 1, the matrix can be installed under water so that the edges of the matrix interlock with the edges of a perviously-installed matrix. A diver may be required to align the arms on the edge of one matrix, with the cavities in the previously-installed matrix, so that as a whole the matrix sections are interlocked together. The installation of one matrix in an interlocking manner with another matrix is similar to a zipper, meaning that as the crane lowers the one matrix, the diver can physically register a first arm with a first cavity, and then as the matrix continues to be lowered, the other arms and cavities readily mate together. The ends of the cables can be suitably anchored in a conventional and well known manner.

Figure 9:
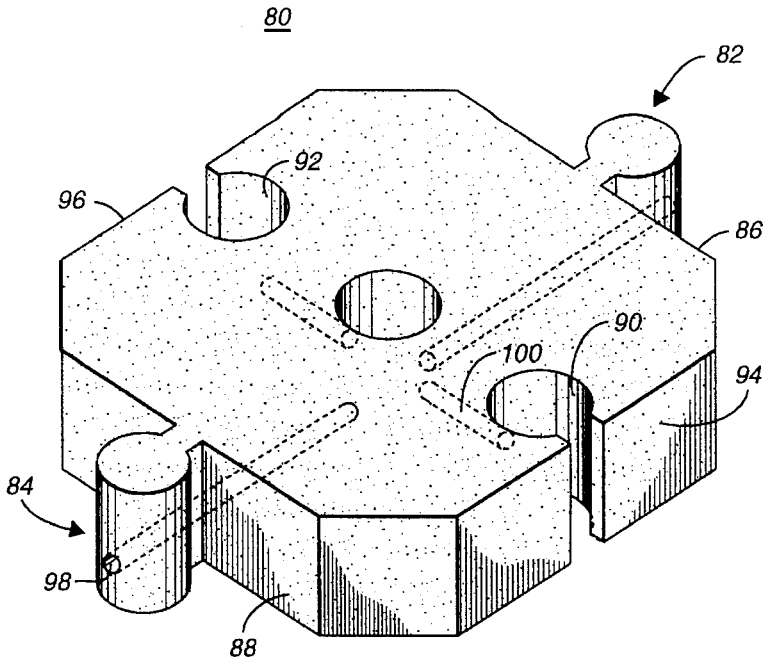
FIG. 9 illustrates another embodiment of the erosion control block of the invention.

FIG. 9 illustrates an erosion control block 80 according to another embodiment of the invention. The block 80 is similar to the block shown in FIG. 1, except block 80 has arms 82 and 84 that are located on diametrically opposing edge faces 86 and 88. Similarly, cavities 90 and 92 are also formed in diametrically opposing edge faces 94 and 96. The arms 82 and 84 are substantially identical in construction as those shown in FIG. 1, as are the cavities 92 and 94. A first cable channel 98 can be formed between the edge faces 88 and 86 having formed thereon the arms 82 and 84, and a second cable channel 100 can be formed between the cavities 90 and 92. The block 80 can be fabricated in the same manner and with the same dimensions as noted above in connection with the block of FIG. 1.

Figure 10:
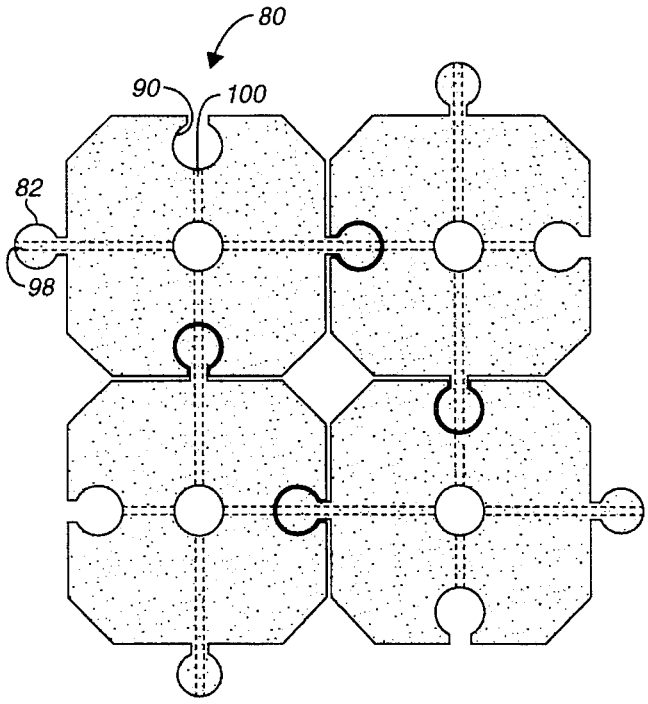
FIG. 10 is a top view of a number of interlocked erosion control blocks of FIG. 9.

The installation of block 80 differs from block 10 (FIG. 1), as the erosion control block 80 requires alternate blocks in a matrix to be rotated 90°, such as shown in FIG. 10. In FIG. 10, there are shown four blocks of the type noted in FIG. 9, interlocked together to form a two-by-two matrix. As noted above, each block is not oriented identically to the adjacent blocks, but rather is rotated 90°. As a result, two perpendicular cable channels are required in each block, in order for a matrix of the same to be cabled together as a matrix. However, like the blocks 10 cabled together in FIG. 8, a matrix of the blocks 80 shown in FIG. 10 only requires a single cable per row of blocks. Again, the matrix of blocks shown in FIG. 10 remain interlocked together with adjacent blocks, even though only a single cable passes through each block.

Figure 11:
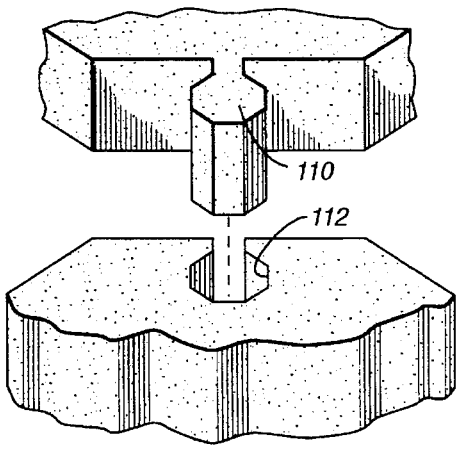
FIG. 11 illustrates the shape of another embodiment of an interlocking arm and cavity according to the invention.

FIG. 11 depicts another arm and receptacle arrangement according to the invention. The arm 110 is an oblong hexagonal shaped enlargement that loosely fits within an oblong hexagonal cavity 112 of an adjacent block. The arm 110 and cavity 112 interlock together to prevent lateral separation. It can be appreciated that from the foregoing interlocking arrangements, yet others are possible, such as oval arm and cavities, square or rectangular arms and cavities, dog-bone shaped arms and cavities, etc.

From the foregoing, an improved erosion control block has been disclosed, which overcomes many of the disadvantages and shortcomings of the blocks known in the prior art. The erosion control blocks of the present invention are not complicated, and can be easily constructed and manufactured at a relatively low cost. The blocks interlock together to form a matrix so as to remain as a unit without the use of cables, and are not easily removed from the matrix or otherwise dislodged by the flow of water thereover. Importantly, each arm of each block interlocks with a cavity of an adjacent block in such a manner that when rotated about a vertical axis, a tension strain, rather than a lateral strain, is applied to the interlocked arm, thereby reducing the tendency of the arm to break from the body of the block.

It should be noted that those skilled in the art may desire to utilize some of the features of the invention, without utilizing all of the disclosed features, and thereby realize the respective advantages of the invention.

While the present invention has been described above with a certain degree of particularity, it is understood that the present disclosure has been made by way of example, and changes in detail or structure may be made to the invention without departing from the spirit and scope of the invention, as defined by the appended claims.

What is claimed is:

1. A block for controlling erosion of soil, comprising;

a body formed of a substantially heavy material, said body having a peripheral side edge with eight edge faces, and a top surface and a bottom surface;

said body including a respective cavity formed in two said edge faces of the body, and an entrance opening that connects each cavity to a respective edge face being smaller than the cavity;

a respective arm formed outwardly from each of two other edge faces of the body, each said arm having an enlarged end portion fittable into a respective cavity of another similar block, and an extension portion of each said arm connecting said other edge face to the respective enlarged end portion, and each said extension portion is loosely fittable in a respective entrance opening to a cavity of another similar block;

the enlarged end portion of said arms of said block being minimally movable radially within the respective cavities of the other similar blocks so as to maintain a given space between the blocks, and said block including four blank edge faces having no arm or cavity, each blank edge face being disposed between edge faces having one of either an arm or cavity, said blank edge faces cooperating with corresponding blank edge faces of three other similar blocks for allowing vegetation growth between four similar blocks; and each said cavity of said block and a respective arm of other similar blocks being interlockable together such that said block and said other similar blocks cannot be radially separated, but allowed to rotate about a vertical axis such that said block can rotate with respect to said other similar blocks and remain interlocked thereto.

2. The block of claim 1, wherein four said edge faces having either an arm or cavity are planar surfaces between the top surface and the bottom surface so as to provide abutting surfaces when said block is rotated maximally with respect to an interlocked said other similar block.

3. The block of claim 1, wherein said entrance opening of each said cavity includes a pair of opposing vertical surfaces that are substantially perpendicular to the respective edge face in which said cavity is formed.

4. The block of claim 3, wherein said extension portion of each said arm has a radial length longer than a radial dimension of the vertical surface of said entrance opening.

5. The block of claim 1, wherein said extension portion of said block is loosely fittable respectively into said entrance portion of a similar said block so as to allow rotatability of said block with respect to said other similar block to an extent that a portion of a peripheral side edge of said block engages a peripheral side edge of said similar block.

6. The block of claim 1, further including a single cable channel formed through said block and having a cable channel opening through one said arm and another cable channel opening through one said cavity.

7. A block for controlling erosion of soil, comprising:

a body formed of a substantially heavy material, said body having a peripheral side edge, and a top surface and a bottom surface;

a cavity formed in the peripheral side edge, said cavity defined by an opening in a portion of the peripheral side edge, a portion of the peripheral side edge on opposing sides of the opening defining first abutting surfaces; and an arm formed outwardly from the peripheral side edge of the body, said arm having an extension and an enlarged portion fittable into a cavity of a similar said block so as to interlock and prevent radial separation, but allowing only limited radial movement between the blocks, a portion of the peripheral side edge on each side of the arm defining second abutting surfaces, whereby when the arm of said block is engaged with a cavity of a similar said block and one said block is rotated a maximum extent about a vertical axis with respect to another said block, a second abutting surface of said block engages with a first abutting surface of said other block so that a radial tension is placed on said arm.

8. The block of claim 7, wherein the cavity and the arm are structured so that when the block is interlocked with said similar block and rotated until said first and second abutting surfaces engage, a radial tension is exerted on the arm, thereby reducing possibility of breakage of the arm.

9. The block of claim 7, wherein said opening of said cavity includes a predefined length connecting the cavity to the peripheral side edge, and said arm includes said enlarged portion that is larger in size than the opening to said cavity.

10. The block of claim 7, wherein said peripheral side edge is octagonal shaped.

11. The block of claim 10, wherein the cavity is formed in the center of one face of said octagonal peripheral side edge, and the arm is formed in the center of another face of said octagonal peripheral side edge.

12. The block of claim 11, wherein said cavity is formed in said one face of said octagonal peripheral side edge so that the arm and cavity are angularly spaced about the block 90° from each other.

13. The block of claim 11, wherein said cavity is formed in said one face of said octagonal peripheral side edge and said arm is formed in an opposite face of said octagonal peripheral side edge so as to be spaced from said cavity about 180°.

14. The block of claim 7, further including two said arms and two said cavities.

15. The block of claim 7, wherein said cavity is circular and the enlarged portion of said arm is circular.

16. The block of claim 7, further including only one cable channel formed therethrough.

17. The block of claim 7, further including only two cable channels formed orthogonal to each other and each through a respective cavity in the peripheral side edge thereof, and wherein only one cable channel is utilized in suspending an array of such blocks together.

18. A method of constructing an erosion control block, comprising the steps of:

forming a block with a receptacle therein by forming a cavity in the block and an entrance portion connecting the cavity to an edge of the block;

forming an arm extending outwardly from an edge of the block by forming an extension portion extending from the edge and having an enlarged end portion formed at an outer end of the extension portion;

forming the enlarged end portion with a size so as to fit within a cavity of a similar said block so as to be interlocked and prevent lateral disengagement therefrom; and forming the extension portion of the arm loosely fittable within an entrance portion of a cavity of another similar block, and forming the extension portion with a length such that when the arm of the block is interlocked within a receptacle of another similar block there is limited radial movement therebetween, and when rotated sideways a maximum extent, an edge of the block abuts an edge of the similar block, thereby placing a radial tension stress on the arm.

19. The method of claim 18, further including forming said arm and said cavity joined to respective planar side edge faces of the block.

20. The method of claim 18, further including forming the cavity and the arm of said block so that when interlocked with a respective arm and cavity of respective similar blocks, and when said block and at least one said similar block is rotated a maximum extent, a majority of a stress induced in the arm extension portion is radial rather than transverse.

21. An eight-sided erosion control block constructed according to the method of claim 18.

* * * * *